US005511588A

United States Patent [19]

Jakšić

[11] Patent Number: 5,511,588

[45] Date of Patent: Apr. 30, 1996

[54] ELECTROMAGNETICALLY ACTIVATED JACQUARD MACHINE WITH ROTATING LIFTING ROLL

[76] Inventor: Danilo Jakšić, Poljanski nasip 30, Ljubljana, Slovenia, 61000

[21] Appl. No.: 377,243

[22] Filed: Jan. 24, 1995

[30] Foreign Application Priority Data

| | | | |
|---|---|---|---|
| Jan. 16, 1994 | [SI] | Slovenia | P-9400039 |
| Nov. 11, 1994 | [SI] | Slovenia | P-9400407 |

[51] Int. Cl.[6] ..... D03C 3/20; D03C 13/00

[52] U.S. Cl. ..... 139/455; 139/59; 139/65

[58] Field of Search ..... 139/455, 59, 65

[56] References Cited

U.S. PATENT DOCUMENTS

| | | | |
|---|---|---|---|
| 4,195,671 | 4/1980 | Bossut . | |
| 4,433,704 | 2/1984 | Decuq . | |
| 4,440,196 | 4/1984 | Arai . | |
| 4,593,723 | 6/1986 | Griffith . | |
| 4,858,654 | 8/1989 | Derudder | 139/455 X |
| 4,936,357 | 6/1990 | Keim et al. . | |
| 5,031,668 | 7/1991 | Bell . | |
| 5,275,211 | 1/1994 | Roth | 139/455 |

*Primary Examiner*—Andy Falik
*Attorney, Agent, or Firm*—Jacobson, Price, Holman & Stern

[57] ABSTRACT

A jacquard machine having lifters controlled by electromagnets. Activated by electromagnets are lifters that, according to the weave pattern, must reside in the upper shed. The lifter is arranged between a continuously rotating lifting roll and an appropriately distanced press roller of an anchor of an electromagnet, the roller pressing the lifter to the mantle surface of the lifting roll when the electromagnet is electrically connected according to the weave pattern. Next to each lifting roll, a series of lifters are positioned. The lifting rolls are arranged so that in a vertical plane, along the width of the warp, there exists a roll matrix composed of mutually equal columns of rolls and mutually equal rows of rolls. The one-column lifting rolls together with the respective lifters, electromagnets and the respective mechanical equipment form a roll module, and two roll modules positioned along the warp compose a roll aggregate. The electromagnets are arranged on traverses and connected, by a connector to an electrical connection plate. For each module an assembly for suspending the lifters is prepared. All lifting rolls obtain continuous, unidirectional, uniform rotation independent of the drive of the weaving loom machine, the jacquard machine being interconnected with the weaving loom machine as to the control functions.

12 Claims, 10 Drawing Sheets

ELECTROMAGNETICALLY ACTIVATED JACQUARD MACHINE WITH ROTATING LIFTING ROLL

BACKGROUND OF THE INVENTION

The invention relates to a jacquard machine of the type having lifters (lifting hooks) controlled by electromagnets.

The jacquard machine as such is a machine which makes it possible to produce, by weaving, textile goods which provide a weave pattern comprising as many differently weaving warp threads as there are available lifters, or their number is divided by two if a double-lift machine is in question. There is not excluded the possibility of suspending several warp threads to a lifter under the condition that the respective pluralities of warp threads have each been uniformly woven with the weft threads. Though a jacquard machine only works together with a weaving loom machine, the development of either of them has followed its own path. Nowadays, one is confronted with the fact that as to the working speeds, the weaving loom machines rather surpass the jacquard machines and, hence, when manufacturing textile goods requiring a jacquard machine, the weaving loom machines are mostly not exploited at their optimum.

It is generally known that the major obstacles to an increase of the manufacturing capacity of jacquard machines reside in the mechanical components thereof, particularly in the reciprocating ones, as well as in cams and levers.

Parallel to the development in the other technical fields, the development of jacquard machines showed long ago that many a problem impeding the manufacturing speed could be avoided if a respective mechanical assembly was substituted by an appropriate electrical equivalent.

Such jacquard machines whose hooks or healds, respectively, are shifted by electromagnets are known e.g. from U.S. Pat. No. 4,936,357 to W. Keim et al. and U.S. Pat. No. 4,593,723 to J. D. Griffith. The expression "shifted by electromagnets" means that a hook or a heald, respectively, is drawn away from the influence of lifting knives. In the said solutions, too, the hook or the heald, respectively, aimed to lift—by means of a double set of pulleys—a warp thread connected with it is lifted to the upper shed by mechanical elements reciprocating in vertical direction and moving similarly to the levers. The two jacquard machines work on the principle of double-lift machines and the lifting knives are therefore arranged in two blade grids. The latter are arranged at the ends of the lifting levers, which cooperate with cams. The prior art jacquard machines thus show all the above-mentioned fundamental disadvantages which prevent the achieving of manufacturing speeds usual at modern weaving loom machines. However, the above-mentioned disadvantage is not the only disadvantage of the prior art jacquard machines. Namely, either of the two blade grids influences one half of the hooks or heald rods belonging to it. To each main harness cord two hooks and heald rods belong so that the total sum of the hooks or heald rods is twice the actual capacity of the jacquard machine—the greatest possible number of different weaving threads in a repeat of pattern (float repeat). Evidently, it involves an enormous number of components and a complex configuration.

It is now thus is now an object of the present invention to avoid the dependence of the mechanical drive of a jacquard machine upon a weaving loom machine and to eliminate the above-mentioned doubling of hooks or healds.

It is a further object of the invention to stabilize the upper portion of a slimly-designed lifter, the term "slimness" of the lifter meaning such a small cross-section of the lifter that, objectively, no lifter butt and no supporting bend as described above are possible.

SUMMARY OF THE INVENTION

According to the present invention, the solution of the problem is based on, a litter arranged between a continuously rotating lifting roll and a press roller of an anchor of an electromagnet, the roller being appropriately distanced therefrom and forcing the lifter to the mantle surface of the rotating lifting roll after the electromagnet has been activated according to the weaving program. Evidently, the pressing of the lifter against the rotating lifting roll results in a jerky raising of the lifter and the components suspended thereon. To provide for the retention of the lifter in the raised position there are provided further components, so that the respective electromagnet can be electrically disconnected at the lifter being raised, which means that the rotating lifting roll does not slide over the lifter.

A series (a set) of lifters is arranged along each lifting roll.

The arrangement of the lifting rolls is such that in the vertical plane along the width of the warp the lifting rolls create a "roll matrix" (a rectangular arrangement of the rolls of a set or sets into rows and columns) with the number of the lifting rolls in a row of rolls being suitably, though not necessarily, greater than that in a column of rolls.

The lifting rolls of a column of rolls are suitably, though not necessarily, assembled to form a constructional block-a roll module. It is an important feature of the jacquard machine of the invention that practically no risk exists of the rolls being too slim (length/diameter ratio). Namely, the lifting rolls of a module can be, if necessary, intermediately supported. Thus, in a suitable layout of a jacquard machine of the invention it is provided that in the direction of the depth of the machine (along the length of the warp), to the first roll modules further roll modules (twin roll modules) are annexed. Evidently, triple roll-modules etc. are also possible according to the invention. The roll modules (twins, triplets etc.) of an axial series of modules composed in the above-mentioned manner form a roll aggregate. Hence, the jacquard machine of the invention is composed of as many roll aggregates juxtaposed to each other along the width of the warp as there are columns of rolls provided in the "roll matrix".

When speaking about a roll module, it is evident that besides the proper lifting rolls the respective lifters, electromagnets and other components of the respective configuration, all belonging to the said module are meant.

A series (a set) of electromagnets belonging to a respective lifting roll of a respective roll module is, with respect to the series of electromagnets belonging to the lifting roll superposing or being superposed by the former, staggered along the lifting rolls so that the clearance between two neighboring electromagnets belonging to the same lifting roll equals the product of as many individual staggerings as there are lifting rolls in the respective roll column.

The electromagnets belonging to a respective lifting roll are arranged on an appropriate traverse and electrically connected by a connector to an electrical connection plate, which is common to all electromagnets of a respective roll module and is, by means of a main connector, incorporated into a main control circuit of the jacquard machine.

Added to each module is a suspension assembly, i.e. an assembly for suspending the lifters provided, according to the weaving pattern, to be lifted and to form the upper shed, the assembly being arranged directly over the lifters and adjustable by height.

The said suspension assembly consists of at least or suitably two three-arm T levers swingably suspended on a journal rod, the downward-oriented lever arms of the said T levers supporting a suspension bar and the arms arranged transversely to the former being arranged below electromagnets that are fastened on a top plate and electrically connected to the connection plate by means of a flat cable.

As for the mechanical drive of the lifting rolls of the jacquard machine, all lifting rolls obtain continuous, uniform, unidirectional rotational drive independent of the drive of the weaving loom machine, the said drive of the jacquard machine being brought in accordance with the highest speed of the weaving loom machine provided to make a respective weaving product. As for the electrical control of the jacquard machine, however, it is naturally coordinated with the state of the weaving loom machine. To this end, on a main shaft of the weaving loom machine molded discs are arranged, whose configuration comprises recesses which in the course of operation activate respective sensing elements which, according to a defined plan, in synchronism with the movement of a loom sley and a comb reed, activate the electromagnets for raising the lifters and the electromagnets for swinging the suspension bar away from below the lifter nose area. On the jacquard machine there are arranged sensing elements for sensing the elevation of the raising of the lifter nose. When the lifter noses pass the sensing elements, the latter disconnect the activated electromagnets and simultaneously activate the electromagnets swinging the suspension bar under the lifter noses, whereafter the last mentioned electromagnets are disconnected, too.

A sensing element on the main shaft of the weaving loom machine, which activatingly influences the electromagnets, activates the latter at the beginning of a shed-closing period and disconnects them as soon as the lifter nose is lowered below the level of the suspension bar. Alternatively, at high-speed looms, the electromagnets provided to swing the suspension bar away from below the lifter noses remain activated also in the shed-closing period, in the closed-shed period and in the shed-opening period.

The drive of the lifting rolls consists of a drive shaft bound to a driving motor, the lifting rolls and the drive shaft being interconnected to realize a synchronous drive.

The synchronous-drive interconnection of the lifting rolls and the drive shaft is embodied by means of synchronous-drive belts. In the embodiment of the jacquard machine having four rows of lifting rolls there are provided two such synchronous-drive belts arranged to envelop, by the first one, the synchronous-drive belt pulleys of the upper and the lower rows of the lifting rolls and, by the other one, the synchronous-drive belt pulleys of the two intermediate rows of the lifting rolls, either of the said synchronous-drive belts additionally enveloping a synchronous-drive belt pulley fastened on the drive shaft.

In a modified solution, a stabilizing abutment is provided next to a deflection stop bar, with the spacing in the horizontal direction between the deflection stop bar and the stabilizing abutment corresponding to the dimension of the lifter over its nose.

BRIEF DESCRIPTION OF DRAWINGS

The invention is shown in more detail by means of an embodiment of a jacquard machine shown in the attached drawing. In the drawings.

DESCRIPTION OF THE PREFERRED EMBODIMENT(S)

Figure 1:
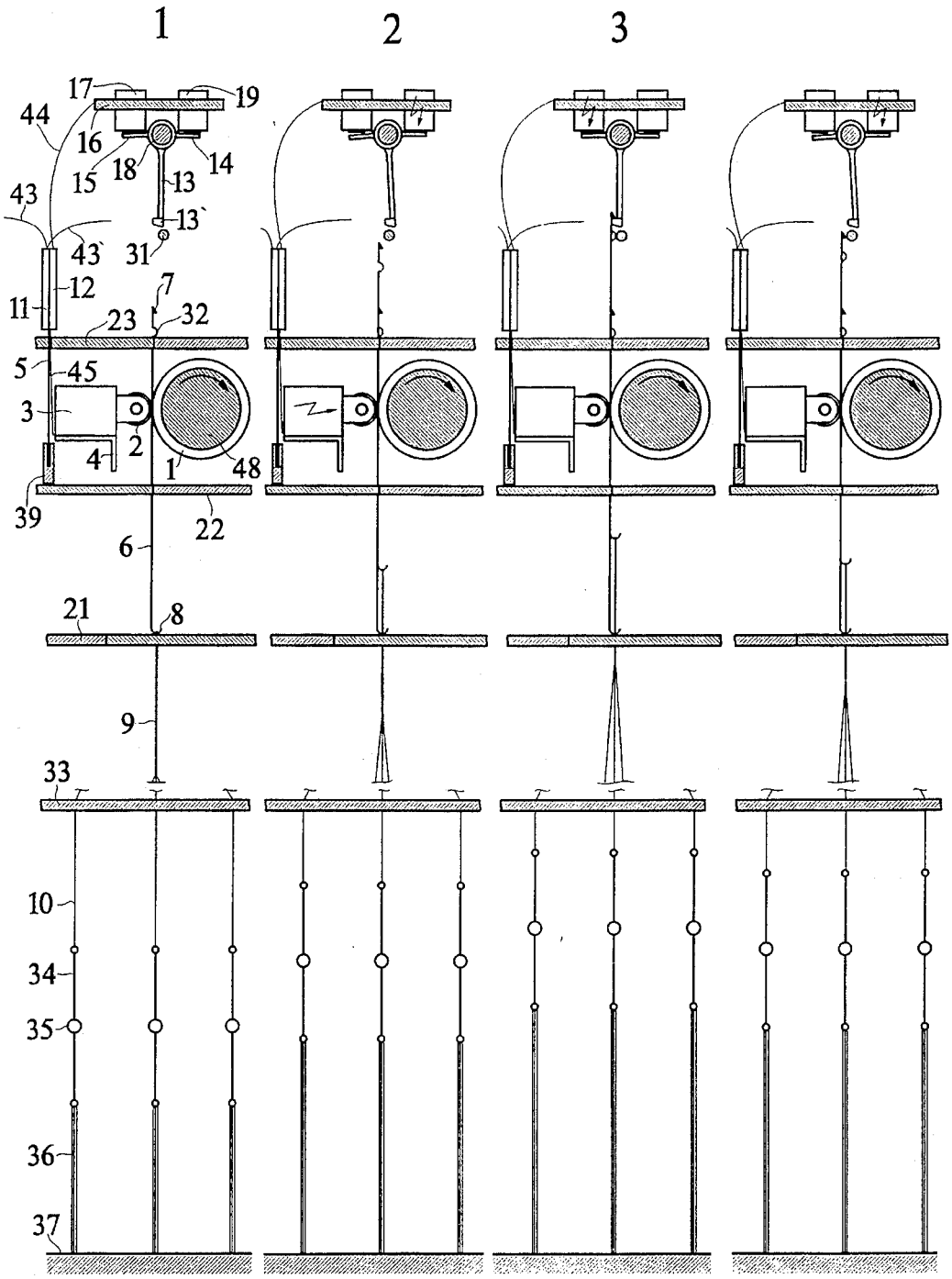
FIG. 1 is an elevation of an illustrative embodiment of a section of a jacquard machine concerning a sole lifting roll with lifters shown in four different working positions to illustrate the working of the captioned jacquard machine, the latter working on the single-lift and upper-shed principle.

FIG. 1 is of auxiliary nature and serves to clearly illustrate the substance of the object of the captioned invention. The four states 1, 2, 3 and 4 resemble the four phases of producing a weaving product: closed-shed state (1), shed-opening state (2), open-shed state (3) and shed-closing state (4). No electromagnet is activated in the state 1, in the state 2 electromagnets 3 and. 19 are activated, an electromagnet 17 is activated in the state 3, and in the state 4 the electromagnet 19 is activated.

The main part of the jacquard machine is an upright lifting-roll aggregate (no respective reference numeral in the drawing; of also FIG. 2), the said aggregate being composed, in the embodiment shown, of twin lifting-roll modules. Each lifting-roll module consists of a column of lifting rolls 1, of a respective number of lifters 6 per roll, of one electromagnet 3 per lifter, a lower lifter guide 22, an upper lifter guide 23, a bottom board 21, a printing-circuit connection plate 5 for providing electrical interconnections, required microelements and connectors 11, 12 as well as of an assembly for suspending and releasing the litters, composed of a journal rod 18, two or more three-arm levers 13-14-15 per journal rod, a suspension bar 13' for suspending the lifters, a top plate 16 and electromagnets 17, 19.

The lifter 6 of the invention comprises a semicircularly shaped lifter butt 8, a lifter nose 7 arranged at the other end of the lifter, and a supporting bend 32 positioned near the lifter nose below it.

States of lifters in FIG. 1:

1 the lifter at the closed shed (analogously to FIG. 3), i.e. in the state when the lifter 6 rests on the bottom board 21 and awaits a signal ordering the raising, whereas the suspension bar 13' resides in the neutral position, i.e. neither the electromagnet 17 nor the electromagnet 19 is activated;

2 the lifter in the shed-opening period (analogously to FIG. 4), i.e. in the state of the respective electromagnet 19 being activated (indicated by the lightning sign), which means that the lifter 6 is pushed by the anchor of the electromagnet 3 via a press roller 2 of the latter and pressed for a determined period against the continuously rotating lifting roll 1 (the rotation indicated by an arcuate arrow), which results in that the lifter 6 jerkily rises; when awaiting the approach of the lifter nose 7, the suspension bar 13' is held swung away (the electromagnet 19 is activated as indicated by a lightning sign);

3 the lifter at the open shed (analogously to FIG. 5), in a state of the lifter 6 having arrived in its final state of raising in the moment of the activation of the electromagnet 17 and swinging the suspension bar 13' below the lifter nose 7 and thereby retaining the lifter 6 in the said position, with the electromagnet 3 being disconnected, and 4 the lifter in the shed-closing period (analogously to FIG. 6), i.e. in the state of the electromagnet 19 being activated, which means the swinging of the suspension bar 13' away from below the lifter nose 7 (simultaneously, the lifter 6 abuts by its supporting bend 32 against a deflection stop bar 31) with the lifter 6 being retracted down by an elastic restoring thread 36 until the lifter butt 8 strikes the bottom board 21 (state 1).

When residing in the stand-by position or moving, the lifter 6 is guided below, beneath the electromagnet 3 and the lifting roll 1 by a lifter guide 22 and above, over the electromagnet 3 and the lifting roll 1 by a lifter guide 23. From the lifter butt 8 a main harness cord 9 is suspended, which runs through the bottom board 21. Onto the main harness cord 9 several auxiliary twines 10 (three auxiliary twines per harness cord in the case of FIGS. 1 and 9) are suspended. The auxiliary twines 10 run through a comber board 33. To the auxiliary twine 10, a thread-lift strip 34 is suspended, which provides an ear 35 for conducting a warp thread and to whose lower end the said elastic retracting thread 36 is connected, which is anchored to a stationary mounting support 37.

As evident from the following description, not only a single electromagnet 3 but a series of electromagnets 3 (and hence a series of lifters 6) are arranged along each lifting roll 1, therefore, for the appropriate arranging of the electromagnets, an appropriate traverse 4 is provided, which in the given case is an L profile. Next to each traverse 4 an upright electrical-connection plate 5 is arranged, which is provided with the required microelements and connectors. The said connection plate 5 is inserted through the upper lifter guide 23 and fastened in a support 39. The connection-plate supports 39 are fixed on bearing walls 28, and the lifter guides 22, 23 are each fixed on supports 40 by means of locating bars 41 and retainers 42, the supports 40 also being suspended on the bearing walls 28.

By means of a main (flat) cable 43, a first electrical-connection plate 5 is connected to a controller (a computer). By means of the connectors 11, the connection plates 5 are mutually interconnected by main cables 43'. By means of a (flat) cable 44, the electromagnets 17, 19 are connected to the connector 12 of the connection plate 5. By means of a (flat) cable 45, the electromagnets 3 are connected to the same connector.

Over the respective series of the lifters 6 belonging to the common lifting roll 1 a suspension assembly (no reference numeral) is arranged. It consists of the said journal rod 18, on which (at least) two three-arm levers 13-14-15 are suspended, preferably suspended freely swingably by means of roll bearings, one lever arm 13 of each lever being directed substantially down and the remaining lever arms 14, 15 being arranged transversely to the former (13) so that there exists a T element. The lever arms 13 of the three-arm levers 13-14-15 are mutually connected by the said suspension bar 13', which is carried thereby. Thus, with respect to the lifter when residing in its lower position, the suspension bar 13' is distanced from the lifter nose 7 exactly for the height of the weaving shed. Over each transverse lever arm 14, 15 an electromagnet 19, 17 is arranged. At least two pairs of electromagnets 17, 19 belonging to a suspension assembly are fixed on the top plate 16.

Directly below the suspension bar 13' there is arranged the said deflection stop bar 31 for supporting the free ends of lifters 6 when releasing them off the suspension bar 13'.

In the embodiment of the jacquard machine as shown, the lifting rolls 1 are arranged in several levels identical to each other, and the number of lifting roll columns and lifting roll modules, respectively, is greater than four.

Figure 2:
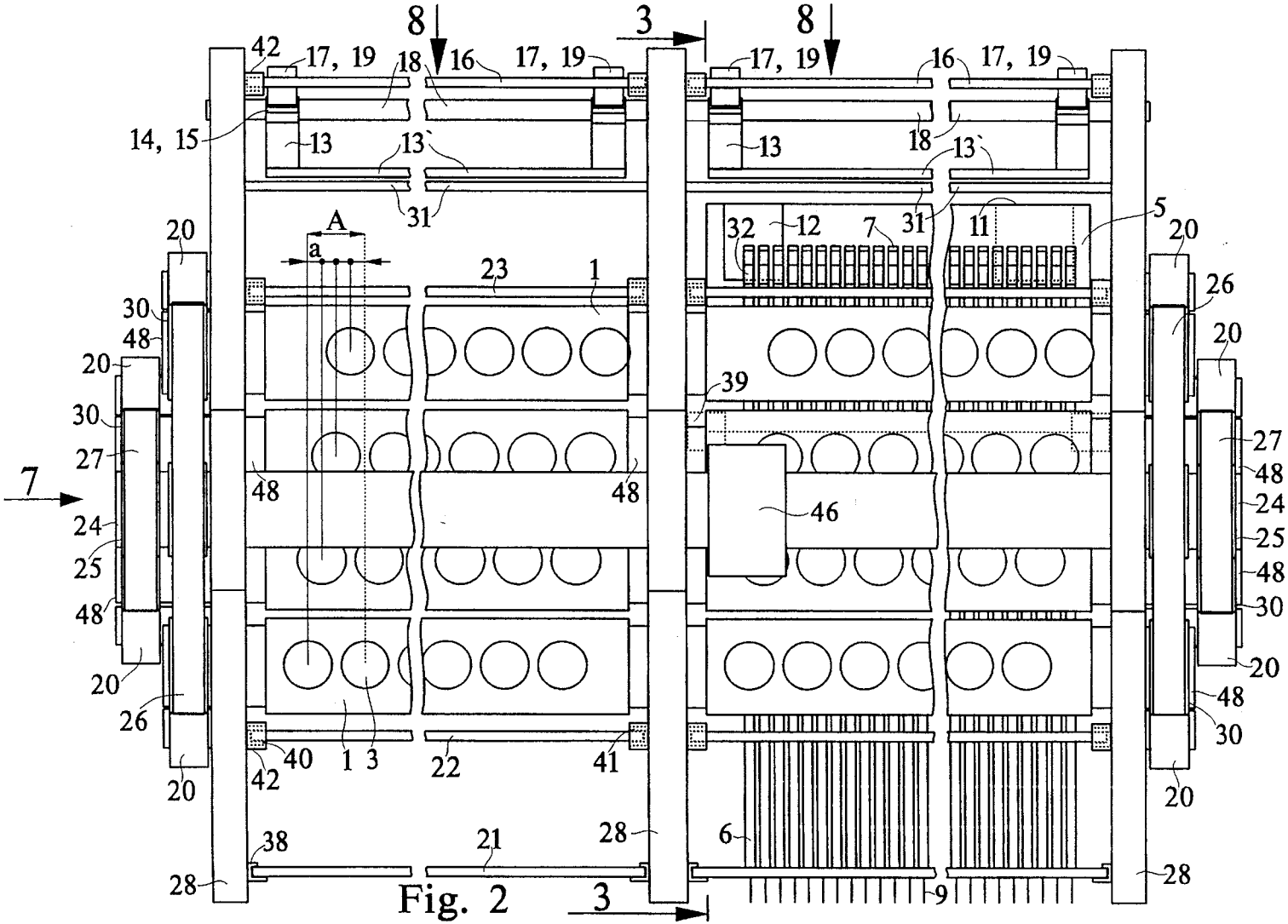
FIG. 2 is a lateral elevation of a twin-module lifting-roll aggregate.

FIG. 2 shows two ($n_1$=2) lifting roll columns (the columns are not provided with special reference marks) positioned side by side and mutually connected in parallel, and two suspension assemblies of a defined embodiment of a jacquard machine of the invention. In FIG. 2 the electromagnets 3 are covered (hidden) by the lifting rolls 1; however, in order to show the staggering in the arrangement thereof in individual levels, the locations of the electromagnets 3 are indicated symbolically by circles. In order to make the drawing clearer, no traverse 4 of the electromagnets is shown in FIG. 2.

It is evident from FIG. 2 that the roll pattern, i.e. the roll matrix geometry of the roll module on the left side of the drawing is identical to the one on the right side of the drawing of the respective lifting roll aggregate, as to the vertical abutting plane of modules. The said medium bearing wall 28 is common to both lifting-roll modules. For each pair of individually coaxial lifting rolls a journal 48 is provided in a respective bearing in the medium bearing wall 28, the journal 48 carrying one of the said lifting rolls 1 at either of its ends. Each lifting roll 1 is also supported at its other end, next to the said outer bearing walls 28, by an appropriate journal 48, which is journalled in a bearing of the respective bearing wall 28. The said journal also projects beyond the bearing wall and is adapted, in this embodiment, to receive a synchronous-drive belt pulley 30. The drive for the roll modules of all roll aggregates (of. also FIG. 8) comes from a (not shown) motor of the jacquard machine by a synchronous-drive belt 47, a synchronous-drive belt pulley 46, two drive shafts 24, several synchronous-drive belt pulleys 25, synchronous-drive belts 26, 27 and. synchronous-drive belt pulleys 30.

Each lifting-roll aggregate consists of lifting-roll modules, in the given case of two of them ($n_1$=2) as stated above, whose lifters can be controlled independently of each other (otherwise no multiphase working of the machine would be possible). A two-module layout of the lifting roll aggregate does not need more than three bearing walls 28. In the given embodiment, the lifting roll module consists of a column of four ($n_2$=4) lifting rolls 1. A single journal rod 18 can run through the entire lifting roll aggregate. The invention makes it possible to divide the jacquard machine to segments; each aggregate then provides its own bearing walls 28, the said walls being firmly connected to each other.

As evident from FIG. 2, the electromagnets 3 are arranged according to a rule as follows:

each lifting roll 1 is accompanied by the same number of electromagnets 3, which is sixteen ($n_3$=16) in the given case, which also means that sixteen lifters 6 are provided;

the electromagnets 3 belonging to each lifting roll 1 are equidistant from each other;

the clearances A between the electromagnets 3 are equal from roll to roll;

the series of electromagnets 3 are staggered equally and in the same sense from the lifting roll belonging to a respective level to the lifting roll of the neighboring level so that e.g. all the first (analogously all the second, all the third etc., up to the last, i.e. the sixteenth ones in a series) electromagnets 3 of all the roll levels form a uniform slanting series of electromagnets, the obliqueness being oriented from the bottom at the left upwards to the top at the right;

the clearance A between two neighboring electromagnets 3 of each lifting roll 1 and the clearances a of the electromagnets from the lifting roll of a respective level to the lifting roll having the same running number and belonging to a neighboring level are mutually defined so that $A=n_2 \times a$=(in the given case where four levels are provided) 4*a*, and the distribution pattern of the electromagnets is identical at all the lifting rolls of a respective level.

Considering the above constructional particulars, the active length of an individual lifting roll 1 or the spacing of two bearing walls 28 of a lifting roll aggregate amount to 17A plus an appropriate addition to accommodate the journals 48. It is provided for the realization of the machine that suitably the pitch is A=25 mm so that, with respect to the orientation to the deepness of the machine, the operational extension of the roll module amounts to approx. 500 mm with the operational length of the lifting roll being 400 mm(=16×25 mm).

It is further evident from FIG. 2 that, arranged on the outer side of the bearing walls 28, the roll aggregates provide driving elements on both sides thereof, that either of two driving assemblies provides driving elements arranged in two planes so that the elements belonging to the first plane reside next to the bearing wall 28 and the elements belonging to the other plane are arranged remotely from the said wall, and that each three-arm lever 13-14-15 with the accompanying electromagnets 17, 19 is positioned next to the bearing wall 28.

If the machine is intended for the production of heavy jacquard-weaving products and thus the suspension bar 13' is exposed to greater bending forces, one or more additional three-arm lever(s) 13-14-15 accompanied by the electromagnets 17, 19 can be provided.

Naturally, if the lifting rolls are relatively slim, the risk of their being twisted is reduced by the both-sides drive thereof. Generally, however, the invention makes it possible to embody a machine providing a single-side drive.

FIGS. 3 to 6 show a sectional elevation of the captioned jacquard machine taken along the line 3—3 of FIG. 2, yet with a difference in comparison to FIG. 2, namely the traverses 4 for the electromagnets 3 are shown and all the retainers for installing the top plate for the electromagnets 17, 19, the lifter guides and the bottom board are omitted. Shown are the supports 39 of the connection plates 5.

It is evident from FIGS. 3 to 6 (cf. also FIG. 8) that a plurality of columns of lifting rolls 1 and, hence, a plurality of roll modules of the machine are juxtaposed to each other. In the given embodiment the number referred to is $n_4$ and amounts to twelve ($n_4$=12). Since in the given embodiment the roll modules, by pairs, constitute the roll aggregates of the machine, it can be calculated that the machine of the shown embodiment is composed of twelve roll aggregates, i.e. twenty-four roll modules.

The jacquard machine according to the invention thus provides:

$n_2$(=4) times $n_3$(=16)=64 lifters/module, $n_1$(=2) times $n_2$(=4) times $n_3$(=16)=128 lifters/aggregate, and total: $n_1$(=2) times $n_2$(=4) times $n_3$(=16) times $n_4$(=12)=1536 lifters.

Figure 3:
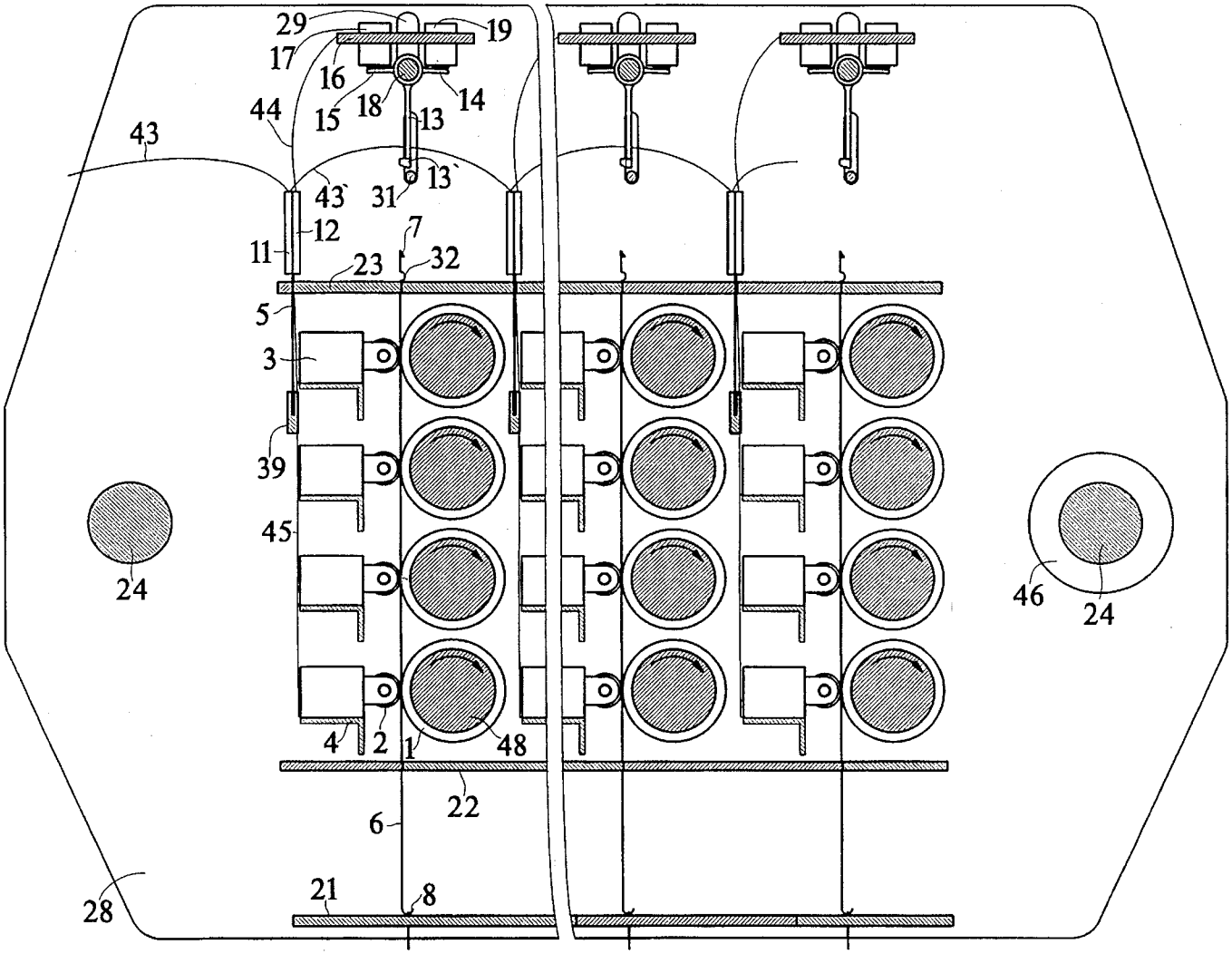
FIG. 3 is an elevational view of section 3—of FIG. 2, the jacquard machine that operates on the single-phase principle being in a closed-shed state.
Figure 4:
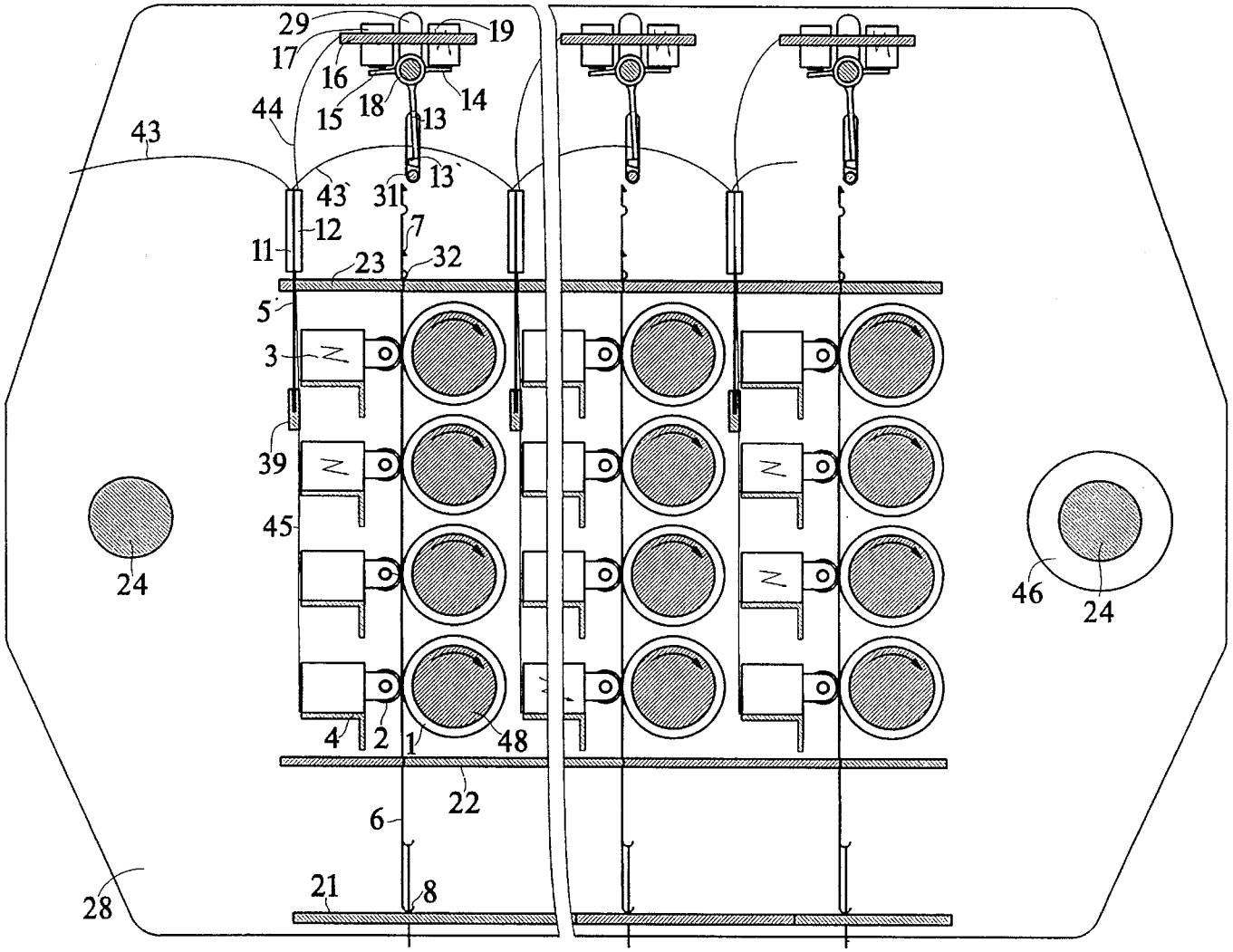
FIG. 4 is the same as FIG. 3 with the difference that the jacquard machine is in a shed-opening state.
Figure 5:
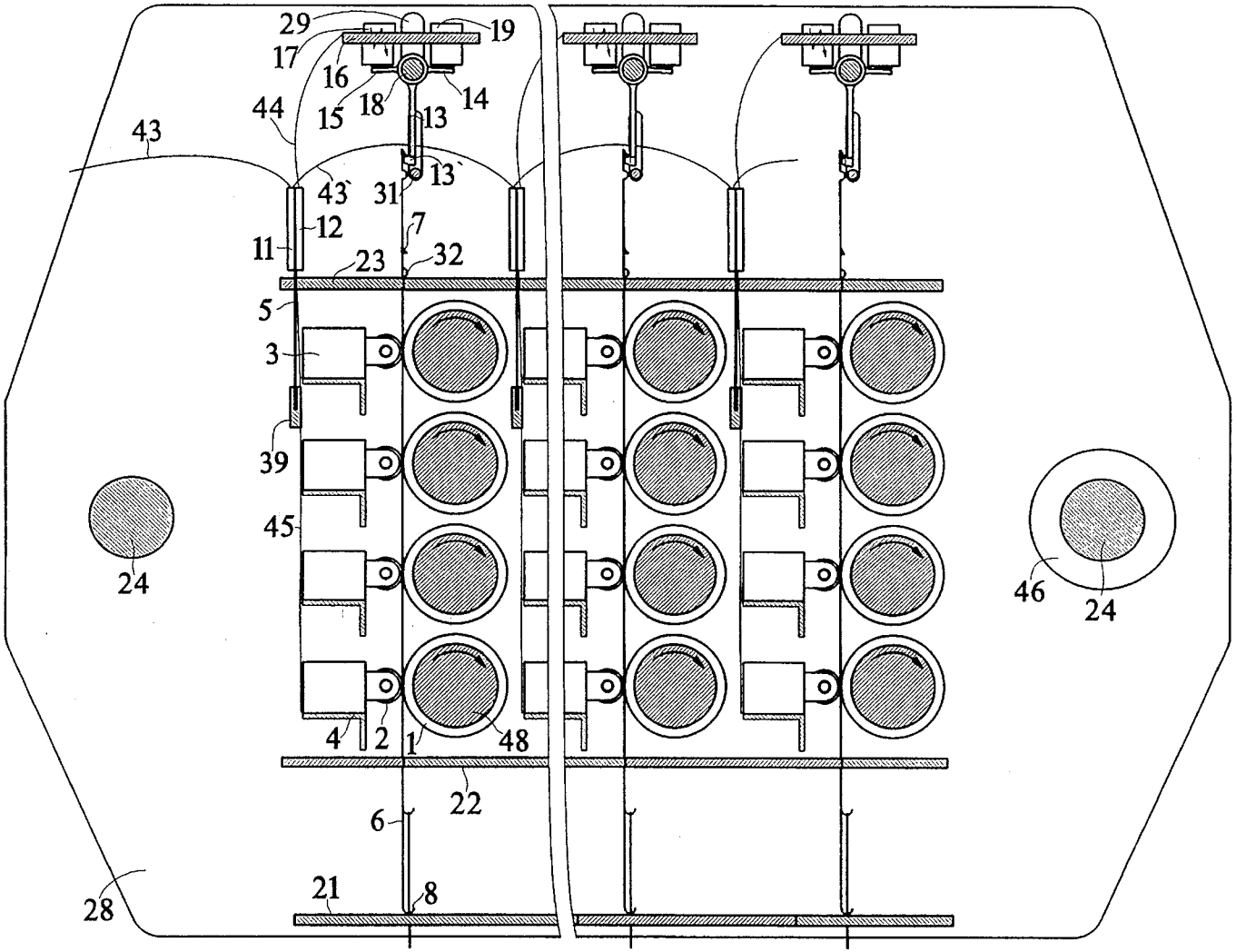
FIG. 5 is the same as FIGS. 3–4 with the difference that the jacquard machine is in an open-shed state.
Figure 6:
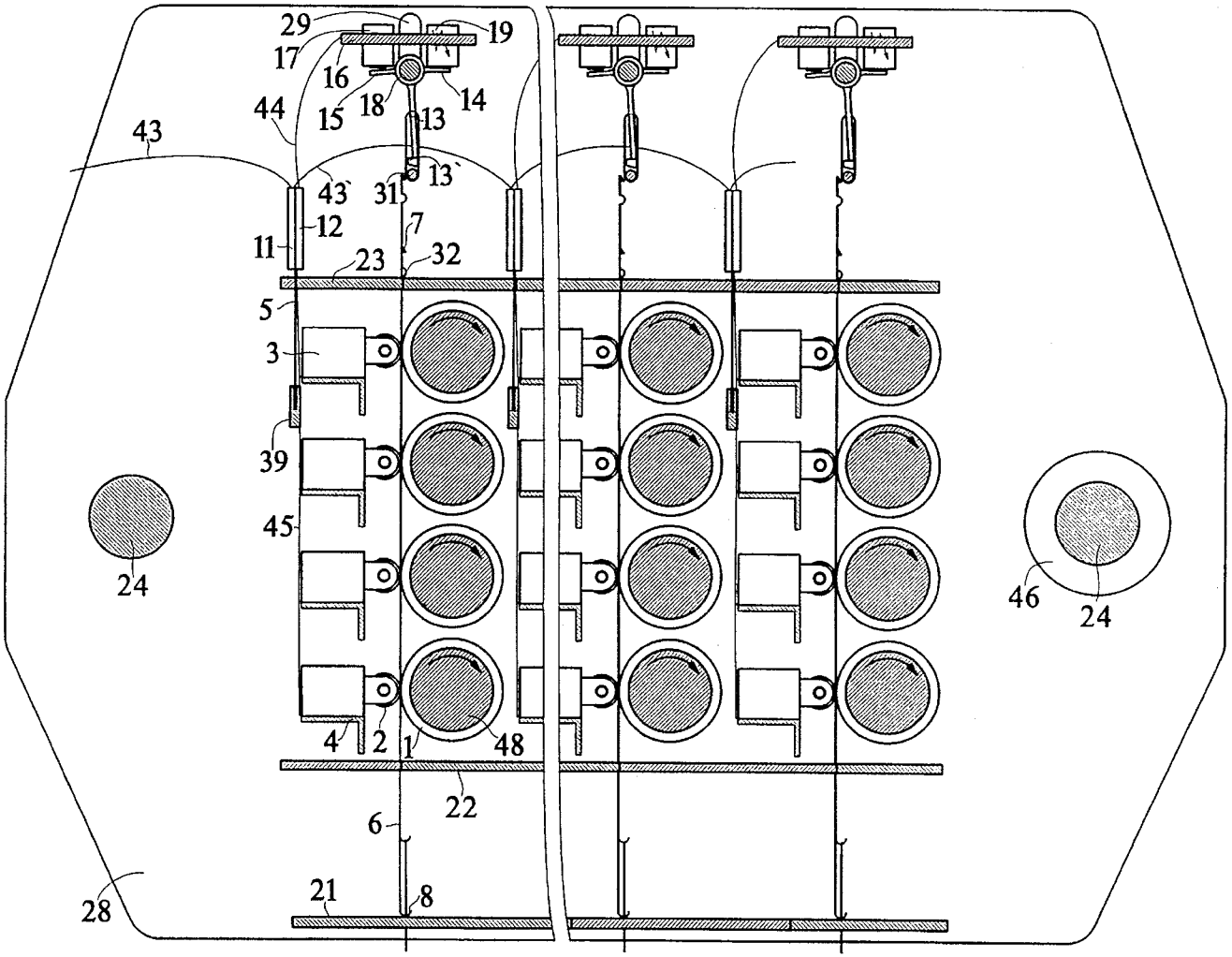
FIG. 6 is the same as FIGS. 3–5 with the difference that the jacquard machine is in a shed-closing state.

The FIGS. 3 to 6 should be dealt with by considering some prerequisites:

not all of the shown electromagnets 3 reside in the (same) plane of drawing; with respect to the location of the section line 3—3 in FIG. 2, the electromagnets 3 of the lower level of the lifting rolls 1 are closest to the plane of drawing of FIGS. 3 to 6, the electromagnets 3 of the next level are positioned deeper by a clearance a etc.;

the shown lifters 6 cooperate each only with the lowest-level lifting roll 1 (i.e. an individual lifter 6 does not cooperate with four electromagnets 3 and four lifting rolls 1); and the states of the lifters 6 as shown are informative ones (single-phase working principle) as follows: according to FIG. 3 all lifters 6 are in the closed-shed phase, in FIG. 4 some lifters 6 (the ones whose electromagnets 3 are marked with the lightning signs) are activated to spread the shed, the remaining ones being in the state of FIG. 3, according to FIG. 5 some lifters 6 are in the open-shed phase, the remaining ones being in the state of FIG. 3, and, finally, in FIG. 6 some lifters 6 are retracted to close the shed, the remaining lifters 6 being in the state of FIG. 3.

By means of FIGS. 3 to 6 it is confirmed that the (theoretical) states 1, 2, 3, 4 of FIG. 1 are possible in a non-altered layout and can also be realized by an appropriate embodiment of the jacquard machine. Besides, the said drawings show an important constructional detail of the suspension assemblies: as to the accommodation of the journal rod 18 and the deflection stop bar 31, both belonging to the said suspension assembly, there are provided, in the bearing walls 28 of the roll aggregate, two pairs of vertically-oblong bearing recesses, namely two recesses 29 for the journal rod 18 and two recesses (without any special reference numeral) for the deflection stop bar 31. By means of the said recesses and appropriate insertions (not shown), which make possible shifting the locations of the journal rod 18 and of the deflection stop bar 31 as well as fixing them in a new position, the height of the weaving shed can be respectively adjusted depending on the type of the weaving product planned. Evidently, the maximum height of a weaving shed is constructionally limited by the distance between the lifter bottom board 21 and the lower lifter guide 22.

When at opening a shed the noses 7 of the lifters 6 are raised (for a few mm) over the suspension bar 13', the electromagnets 3, 19 are electrically disconnected and the electromagnets 17 are connected so that the suspension bar 13' is swung below the lifter noses 7. After the disconnecting of the electromagnets 17, the lifters 6 in the raised position get suspended by their noses 7 on the suspension bar 13'.

When producing a heavy jacquard-weaving product, the loading of the suspension bar 13', generated by the lifters suspended thereon might be risky. In order to guarantee a safe removal of the lifters 6 off the suspension bar 13', the invention provided a short-period switching on of the electromagnets 3, which means a raising of the lifters 6 over the suspension bar 13', and a subsequent swinging of the suspension bar 13', now released, off the noses 7 of the lifters 6.

Figure 7:
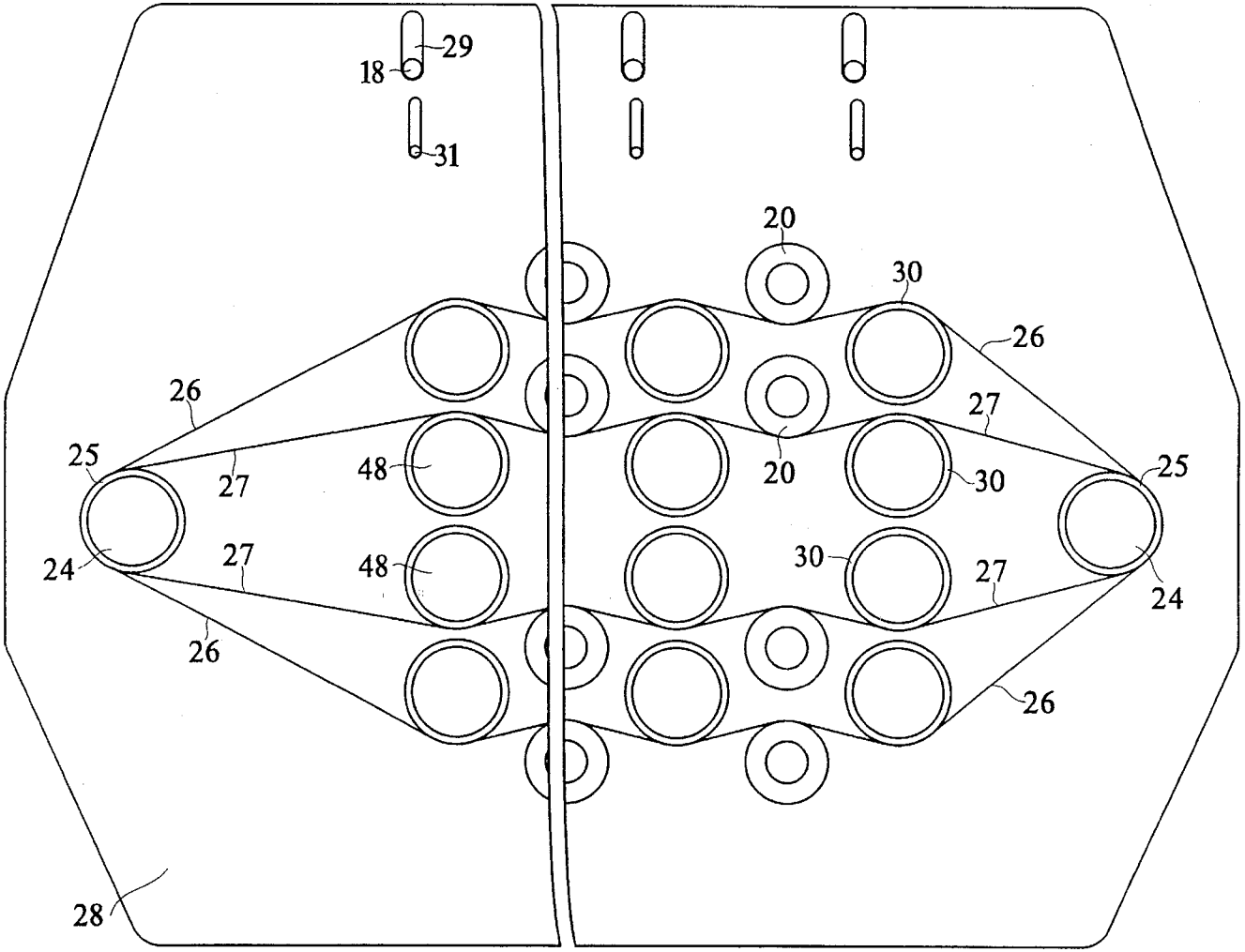
FIG. 7 is an elevational view of the jacquard machine in the direction of arrow 7 of FIG. 2.

From FIG. 7 further details of the synchronous and unidirectional drive of the lifting rolls 1 of the machine are evident. On the journal 48 of each lifting roll 1 from the outer side of the outer end-bearing wall 28, the respective interconnection being firm, the said synchronous-drive belt pulley 30 is put, with all the synchronous-drive belt pulleys 30 of the lifting rolls 1 being equal. In the given embodiment, the synchronous-drive belt pulleys 30 belonging to the upper and to the lower of four levels of lifting rolls 1 reside next to the end bearing wall 28 (FIG. 2) and one of two equal synchronous-drive belt pulleys 25 on each drive shaft 24 is adapted to them, whereas the synchronous-drive belt pulleys belonging to the two middle levels of lifting rolls 1 are staggered outside for the width of the synchronous-drive belt pulley 30 and to them the other of the two synchronous-drive belt pulleys 25 on each drive shaft 24 is adapted. Suitably, though not necessarily, the drive shafts 24 are arranged, with respect to the height of the machine, in the middle of the four levels of lifting rolls 1, i.e. between the levels two and three. The said synchronous-drive belt 26 is put envelopingly over the synchronous-drive belt pulleys 30 of the upper and lower levels, i.e. the levels four and one, of the lifting rolls 1 and over the respective synchronous-drive belt pulleys 25 and, analogously, the said synchronous-drive belt 27 is put envelopingly over the synchronous-drive belt pulleys 30 of the two middle levels, i.e. levels two and three, of the lifting rolls 1 as well as over the respective synchronous-drive belt pulleys 25. Between the pulleys of each pair of the neighboring synchronous-drive belt pulleys 30 of a respective level, the synchronous-drive belts 26 and 27, respectively, are supported from the other side each by a freely rotatable support roller 20. Consequently, the support rollers 20 of the levels one and two of the lifting rolls 1 reside below the synchronous-drive belts 26 and 27, respectively, and the support rollers 20 of the levels three and four of the lifting rolls 1 reside over the synchronous-drive belts 26 and 27, respectively.

According to the invention, the number of the levels of the lifting rolls 1 is suitably an even one, although the embodiment disclosed does not exclude machines with an odd number of levels. The appropriate adaptations are possible on the basis of routine constructional knowledge.

Figure 8:
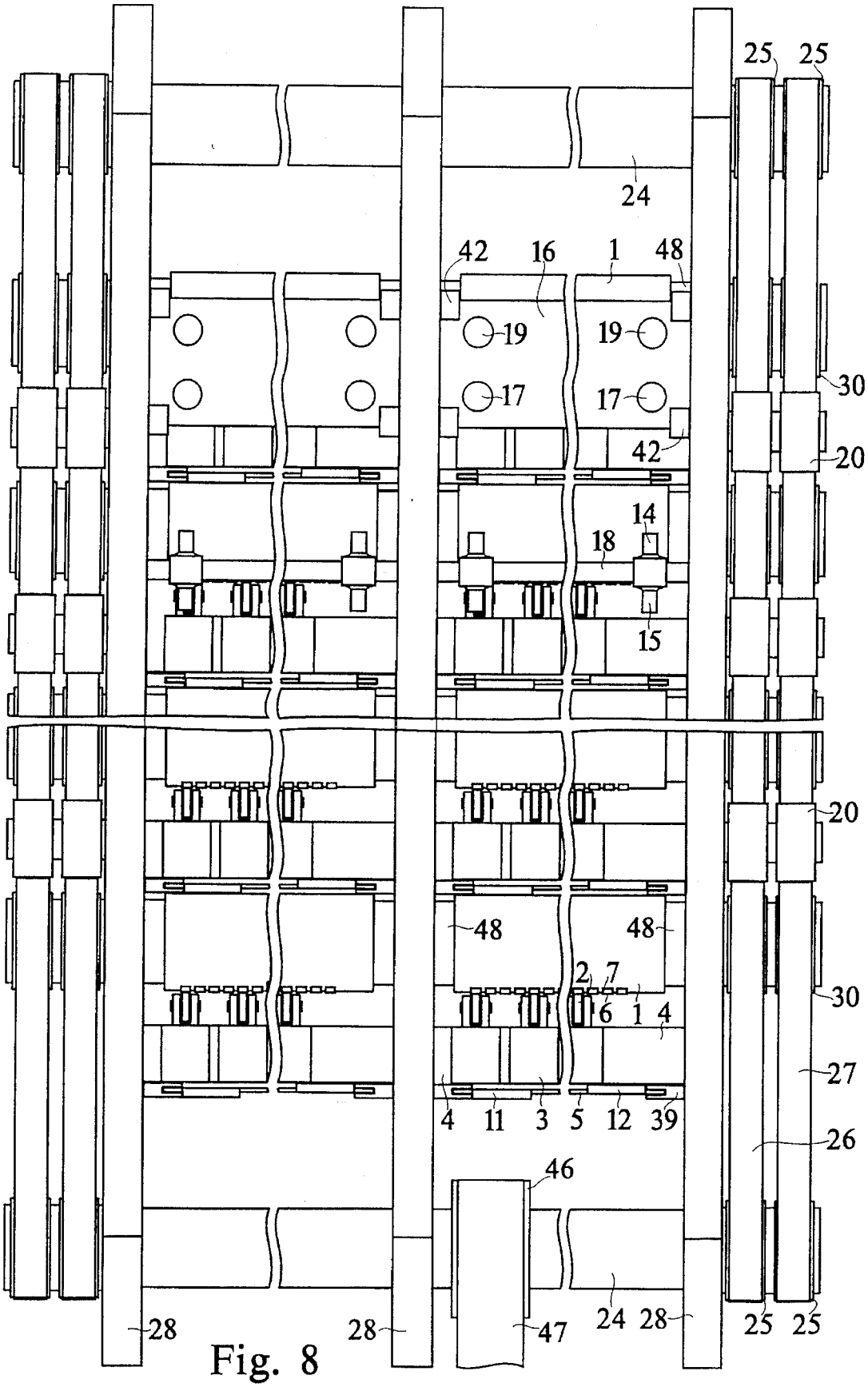
FIG. 8 is a plan (to FIGS. 3–7) of the jacquard machine.

FIG. 8 shows the jacquard machine as seen in the direction of arrow 8 of FIG. 2, i.e. the plan of the machine. In order to make the drawing suitably clear, lifter guides 22, 23, the deflection stop bar 31 and the bottom board 21 are not shown in the drawing. Most completely the configuration represented at the top of FIG. 8 is shown; in the next section the top plate 16 and the electromagnets 17, 19 are missing; in the further sections the entire lifter-suspending assemblies have been omitted. With the exception of the electric motor, the entire drive of the rolls is evident from this drawing.

Figure 9:
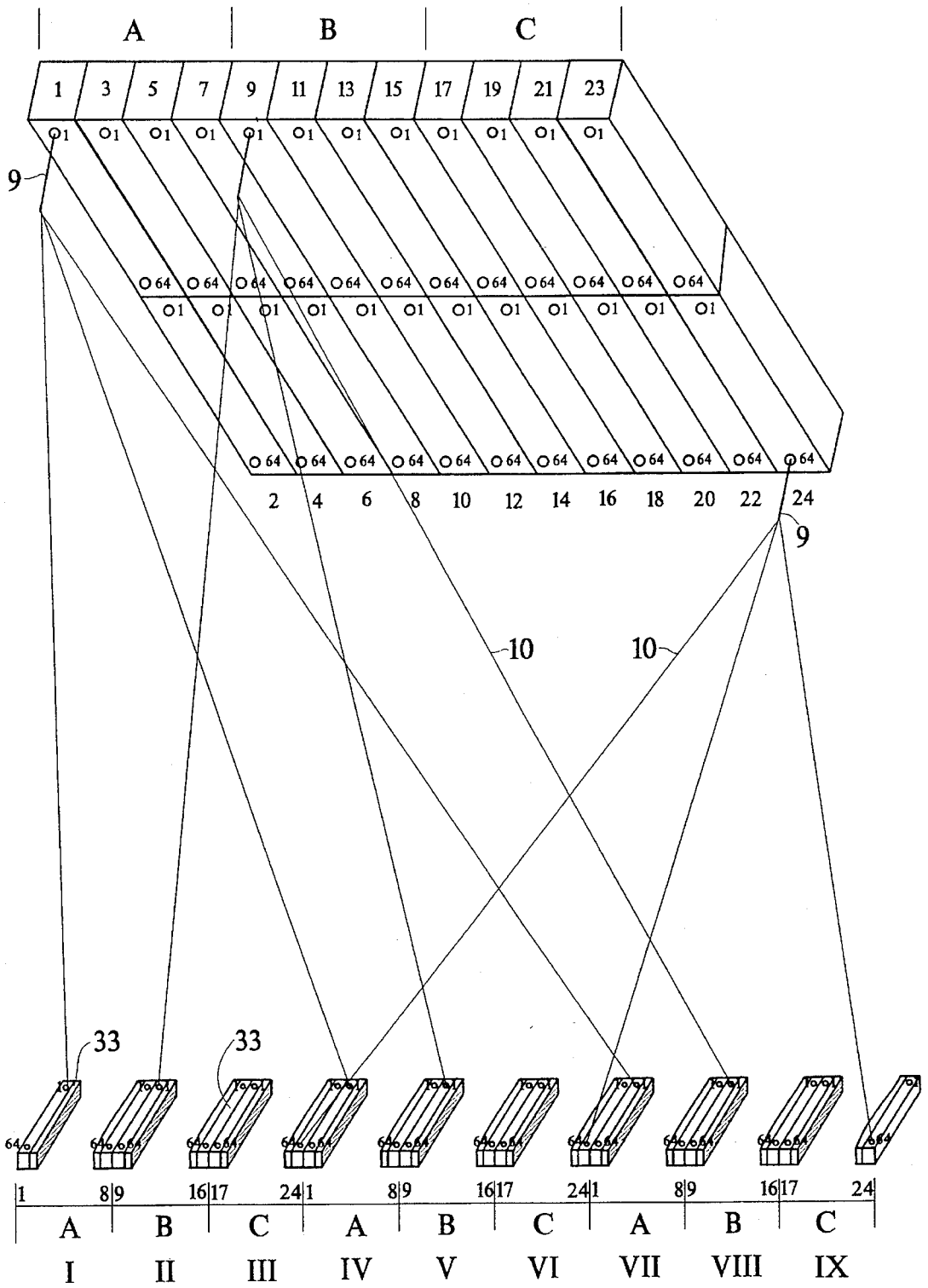
FIG. 9 is a harness mounting layout of a multiphase jacquard machine, adapted to a multiphase weaving loom machine.

FIG. 9 is a three-dimensional view from the cloth roller to the warp beam (in the direction of the warp layout) and shows the lacing (harness) of the machine, i.e. the interconnection of the jacquard machine (upper part of the drawing) and of the comber board 33 of the weaving loom machine. The roll modules of the jacquard machine are designated by numerals 1 through 24; the ones with odd numerals 1,3, . . . , 23 reside in the front, and those with even numerals 2,4, . . . , 24 are in the back. One odd-numbered module and one even-numbered module of each pair of modules constitute a roll aggregate (1-2, 3-4, . . . , 23-24), the aggregates, however, do not bear particular reference numerals. Each roll module comprises sixty-four lifters, the said lifters being designated by numerals$^{1}$. . . $^{64}$.

To facilitate the interconnecting of the jacquard machine and the multiphase weaving loom machine by the harness cords and auxiliary twines, the roll aggregates of the former are assembled into three blocks A, B, C encompassing each four aggregates per block and eight modules per block, respectively. The block A comprises modules 1 through 8, block II the modules 9 through 16, and block C the modules 17 through 24.

Practical reasons, depending on the multiphase weaving loom machine, lead to the jacquard machine being divided into three blocks. In a general layout, the weaving loom machine has eight shaft segments per wave. Thereby it is only possible to make weaving products providing a plain weave characterized by solely two differentlybinding threads in a repeat of pattern.

A roll module of the jacquard machine substitutes a shaft segment of the multiphase weaving loom machine, yet with an important difference. By lifting/lowering the shaft segment, all the threads in the shaft segment (i.e., comparatively, sixty-four threads) are lifted/lowered simultaneously to the upperlower position of shed, whereas a respective thread can be controlled individually by the roll modules of the jacquard machine of the invention. Provided that the electromagnet 3 is activated, the respective thread is lifted to the upper shed, otherwise it remains in the lower shed. Hence, the proposed jacquard machine creates the so-called upper shed; the threads not being lifted remain in the closed-shed plane and constitute the lower shed.

The moment of the activation of the electromagnets 3, 17, 19 of a respective roll module is independent of the moment of the activation of the electromagnets of the remaining roll modules of a respective block A, B, C. Between the blocks A, B, C, however, a simultaneous activating of the electromagnets is guaranteed, which each have the same position in the blocks, e.g. the activating of the electromagnets in the modules 1, 9, 17; 2, 10, 18; . . . ; 8, 16, 24. The time interval of the activation of electromagnets is such that each block A, B, C creates an identical wave.

From the point of view of control, each block A, B, C is thus composed of eight jacquard (sub-)machines.

In the given embodiment the comber board 33 is adapted to the circumstance that to each harness cord 9 three auxiliary twines 10 are suspended. Consequently, the number of the guiding passages in the comber board 33 for the auxiliary twines is three times the number of the harness cords 9 and of the lifters 6, respectively, thus three times 1536, which amounts to 4608 guiding passages of the comber board.

Analogously to the jacquard machine being divided into blocks A, B, C, the comber board 33 is also divided into groups of blocks A, B, C, the number of groups being determined according to the number of the auxiliary twines suspended to a harness cord, which is three in the given case. Consequently, the comber board 33 is divided into three groups of three blocks A, B, C each, the total being nine blocks I . . . IX of the comber board 33. Each block A, B, C of the comber board 33 has as many numerated guiding passages for the auxiliary twines as there are harness cords and lifters, respectively, in each module 1 . . . 24 of the machine, i.e. sixty-four in the given case.

The technique of arranging the auxiliary twines 10 through the comber board 33 simply depends on the numbering of the modules of the jacquard machine, the litters and the blocks/modules of the comber board 33. The technique as such is shown in the drawing on an example of three lifters as follows.

| Example No. | Location | Description |
|---|---|---|
| 1 | Block A of the jacquard machine, module No. 1, lifter (≡ main harness cord) No.[1] | Each of three auxiliary twines 10 is led through the block A of the comber board 33 through the module No. 1 through the guiding passage No.[1]. |
| 2 | Block B of the jacquard machine, module No. 9, lifter (≡ main harness cord) No.[1] | Each of three auxiliary twines 10 is led through the block B of the comber board 33 through the module No. 9 through the guiding passage No.[1]. |
| 3 | Block C of the jacquard machine, module No. 24, lifter (≡ main harness cord) No.[64] | Each of three auxiliary twines 10 is led through the block C of the comber board 33 through the module No. 24 through the guiding passage No.[64]. |

By a lifter (=main harness cord) being shifted, all three auxiliary twines bound thereto as well as all three warp threads bound thereto move. A jacquard machine embodied in the above manner works on a multiphase principle. In this example, in a given moment, to each block A, B, C (≡I, . . . , IX) of the comber board 33 the weaving shuttle residing in that position belongs, if an open shed (a wave of the shed) is formed. Thus e.g. block A forms waves at the sections of the blocks I, IV and VII of the comber board 33. Evidently, the inventor succeeded in constructing a blade-gridless jacquard machine, i.e. a machine comprising neither lifting levers nor cams. There was no necessity to redouble the number of lifters in comparison to that of the main harness cords. A direct driving dependence of the jacquard machine upon the weaving loom machine was avoided, which resulted in diverse possibilities of selecting the drive of the jacquard machine. By creating the possibility to make the shed on the single-lift principle, the number of lifters at a given capacity of the jacquard machine was reduced by half in comparison with a known jacquard machine working on the double-lift principle. Since the proposed jacquard machine is invariable with respect to the "phases" of the shed, the machine can be applied both with single-phase (simple-shed) and multiphase (multiphase-shed) weaving loom machines by merely changing the software; no intervention into the jacquard-machine hardware itself is required. The only change concerns the number of sensing elements of the weaving loom machine, which are arranged on a respective shaft, whose number of revolutions equals to that of the weaving loom machine. Three sensing elements are required to activate the electromagnets 3, 17, 19, if the machine works on the single-phase weaving principle. However, in order to work on the multiphase principle, the jacquard machine needs a further sensing element that senses, within the one-revolution period of the shaft of the weaving loom machine, eight times the circumstance whether the shaft of the weaving loom machine rotates or not.

By avoiding great reciprocatingly-moving masses, the speed of the jacquard machine could be increased, without risk, up to the speed of modern high-speed weaving loom machines.

In the preferred embodiment two modules form a roll aggregate, yet the invention is not limited thereto. Depending on the planned capacity of the jacquard machine, the aggregate can simply be the roll module itself or the number of modules can be more than two. The number of aggregates, twelve in the given embodiment, does not represent a limitation either, if the modules of the comber board are arranged in a single series and the comber board of the weaving loom machine is adapted to that number.

Each module 1 . . . 24 of the jacquard machine providing sixty-four lifters, has its own "address" in the preset control course if working on the multiphase principle. A transformation of the jacquard machine from the multiphase-principle weaving layout to a single-phase-principle weaving layout is thus based merely on an alteration of the preset course.

The width of the comber board 33, i.e. the dimension along the series of sixty-four numbered guiding bores for the auxiliary twines, complies with the width of the shaft segments of the weaving loom machine, the former width being equal to the latter one and normally smaller than the width of the module of the jacquard machine, i.e. the dimension thereof along the sixty-four lifters. The said feature makes it possible to reconstruct each multiphase weaving loom machine, which by means of the camprovided shaft and the shaft segments forms a simple shed (plain weave), for weaving by a jacquard machine of the invention. It is only necessary to remove the mechanism for forming the shed and to exchange it by the captioned jacquard machine.

Figure 10:
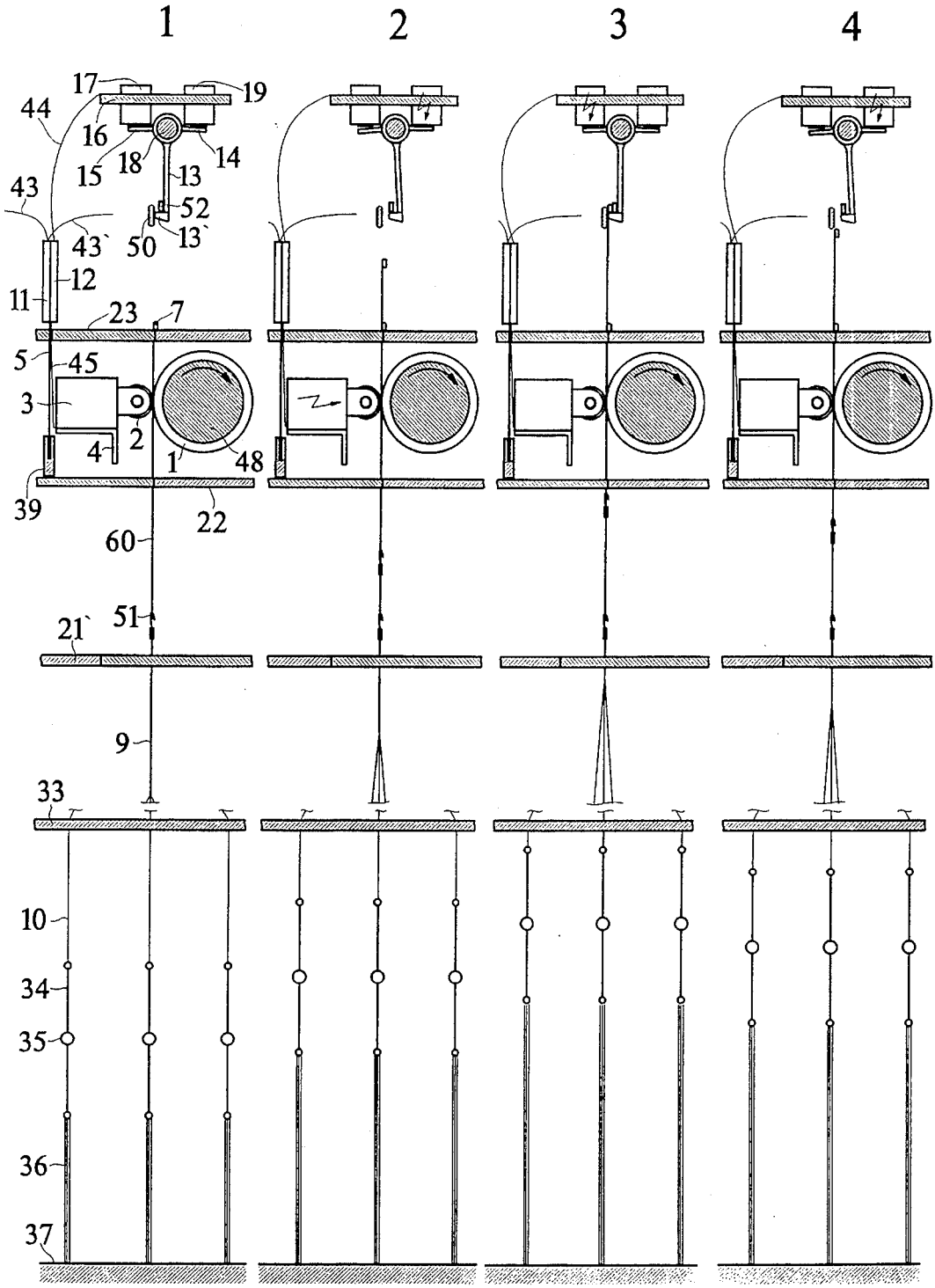
FIG. 10 is a modification of FIG. 1.

FIG. 10 shows a deflection stop bar 52 positioned directly over the suspension bar 13', with a stabilizing abutment 50 being positioned in front of the front surface of the suspension bar 13'. A horizontal distance of the stabilizing abutment 50 to the deflection stop bar 52 corresponds to the dimension of the lifter over its nose 7. Substantially, a modified lifter 60 consists of a simple steel band which at the lower end provides an opening 51 for a connecting hook of the main harness cord and at the other end it provides a lifter nose 7 which is the only element projecting from the surface of the lifter-band.

I claim:

1. A jacquard machine comprising a plurality of lifters, a continuously rotatable lifting roll having a roll surface adjacent to said plurality of lifters, a plurality of electromagnets, each said electromagnet associated with a press roller and means for connecting said press roller to said electromagnet for movement of said press roller upon activation of said electromagnet, said press roller positioned adjacent one of said lifters whereby said lifter is between said press roller and said rotatable lifting roll, whereby activation of each said electromagnet moves said press roller against said lifter to force the lifter to the roll surface of said rotatable lifting roll whereby rotation of the lifting roll results in a raising of the lifter.

2. A jacquard machine as claimed in claim 1 further comprising a plurality of rotatable lifting rolls, each of said rotatable lifting rolls having a roll surface adjacent to a plurality of lifters, and whereby a plurality of electromagnets is arranged along the length of each of said lifting rolls.

3. A jacquard machine as claimed in claim 2 wherein said plurality of rotatable lifting rolls are arranged in a matrix of columns and rows.

4. A jacquard machine as claimed in claim 3 further comprising a pair of matrixes defining first and second modules arranged in side-by-side relationship.

5. A jacquard machine as claimed in claim 3 wherein adjacent electromagnets along the length of each lifting roll are spaced by a distance "A", and wherein adjacent electromagnets in a column of lifting rolls are displaced in a direction along the length of each lifting roll by a distance "a", such that the distance "A" is equal to the product of "a" and the number of lifting rolls in said column.

6. A jacquard machine as claimed in claim 1 further comprising a suspension assembly positioned above said lifters for suspending the raised lifters in accordance with a weaving pattern.

7. A jacquard machine as claimed in claim 1 wherein said suspension assembly includes a T-shaped lever having three arms, said lever suspended and swingable about a journal rod, one arm oriented downwardly and supporting a suspension bar, the other two arms extending transverse to said downwardly oriented arm, and a pair of suspension assembly electromagnets, each suspension assembly electromagnet arranged adjacent to one of said transverse arms.

8. A jacquard machine as claimed in claim 3 further comprising mechanical drive means for continuously rotating each of said lifting rolls in the same rotational direction.

9. A jacquard machine as claimed in claim 8 wherein said mechanical drive means comprise a drive shaft of a driving motor, and means for connecting said drive shaft with said lifting rolls to synchronously drive said lifting rolls.

10. A jacquard machine as claimed in claim 9 wherein said means for connecting said drive shaft with said lifting rolls comprises a pair of synchronous-drive belts arranged to envelop lifter roll drive belt pulleys connected with each of said lifter rolls, wherein one of said drive belts envelops the uppermost and lowermost rows of lifter roll drive belt pulleys, and the other of said drive belts envelops two intermediate rows of lifter roll drive belt pulleys.

11. A jacquard machine as claimed in claim 7 further comprising a deflection stop bar positioned adjacent to and above said suspension bar and a stabilizing abutment positioned adjacent to and in front of a front surface of said suspension bar.

12. A jacquard machine as claimed in claim 11 wherein each said lifter includes a lifter nose for capture by said suspension bar in cooperation with said deflection stop bar and said stabilizing abutment, whereby the distance between said deflection stop bar and said stabilizing abutment is substantially equal to the dimensions of said lifter nose.

* * * * *